US006482138B1

(12) United States Patent
Nelson

(10) Patent No.: US 6,482,138 B1
(45) Date of Patent: Nov. 19, 2002

(54) ROTATIONAL FRICTION EXERCISE DEVICE SELECTIVELY ATTACHED TO A SUPPORT SURFACE

(76) Inventor: Keith Nelson, 4555 Sawmills School Rd., Granite Falls, NC (US) 28630

( * ) Notice: Subject to any disclaimer, the term of this patent is extended or adjusted under 35 U.S.C. 154(b) by 337 days.

(21) Appl. No.: 09/620,229

(22) Filed: Jul. 20, 2000

(51) Int. Cl.[7] ..... A63B 21/015
(52) U.S. Cl. ..... 482/118; 482/904
(58) Field of Search ..... 482/44, 65, 92, 482/114, 115, 904, 117–119, 127, 128; 601/23

(56) References Cited

U.S. PATENT DOCUMENTS

| | | | | | |
|---|---|---|---|---|---|
| 562,520 | A | * | 6/1896 | Fonda | 482/65 |
| 2,190,895 | A | * | 2/1940 | Turpin | 482/115 |
| 2,817,524 | A | | 12/1957 | Sadler | 272/79 |
| 3,013,799 | A | * | 12/1961 | Wise | 482/118 |
| 4,051,560 | A | * | 10/1977 | Audet | 482/119 |
| 4,114,874 | A | * | 9/1978 | Mattila | 482/118 |
| 4,225,130 | A | * | 9/1980 | Zimmerman | 482/60 |
| 4,611,807 | A | * | 9/1986 | Castillo | 482/119 |
| 4,739,984 | A | * | 4/1988 | Dranselka | 482/118 |
| 4,749,182 | A | | 6/1988 | Duggan | 272/73 |
| 4,900,014 | A | * | 2/1990 | DeGraff | 482/904 |
| 5,062,633 | A | * | 11/1991 | Engel et al. | 482/118 |
| 5,125,882 | A | * | 6/1992 | La Mothe et al. | 482/114 |
| 5,154,684 | A | * | 10/1992 | Delf | 482/118 |
| 5,158,519 | A | | 10/1992 | Hughes | 482/118 |
| 5,380,259 | A | * | 1/1995 | Robertson et al. | 482/128 |
| 5,505,681 | A | * | 4/1996 | Bruggemann | 482/904 |
| 5,540,641 | A | * | 7/1996 | Williams et al. | 482/115 |
| 5,580,338 | A | | 12/1996 | Scelta et al. | 482/62 |
| 5,730,686 | A | * | 3/1998 | Nilsson | 482/115 |
| 6,117,093 | A | * | 9/2000 | Carlson | 482/44 |

* cited by examiner

*Primary Examiner*—Jerome W. Donnelly
*Assistant Examiner*—Victor Hwang
(74) *Attorney, Agent, or Firm*—Patent & Trademark Services; Thomas Zack; Joseph H. McGlynn

(57) ABSTRACT

An exercise device having a hollow housing that can be fixed to a horizontally disposed support surface by a first external clamp. Extending from the housing is a handle with a first shaft that extends into the housing. Within the housing on the first shaft is a disk fixed to the shaft that rotates with the shaft. As a user rotates the handle its shaft and disk rotate in unison. A resistive force control handle also extends from the housing has its own second shaft extending within the housing. This second shaft mounts a second member consisting of two disk engaging rollers whose resistance to rotation can be adjusted. As the rollers resistance to rotation is increased against the engage disk's surface more force is needed to move the external handle on the disk's shaft. One roller engages the top of the disk while another engages the bottom of the disk. Two pairs of arms are joined at one end to a movable shaft while the other end has a roller at each one of the pairs of arms. The pairs of arms are spaced V-shaped with the apex being opposite the end with the roller. As the control shaft rotates it moves the two pairs of engaged arms to vary their spacing apart and to change the rolling resistance of the rollers against the contacted disk's surface.

7 Claims, 2 Drawing Sheets

ROTATIONAL FRICTION EXERCISE DEVICE SELECTIVELY ATTACHED TO A SUPPORT SURFACE

BACKGROUND OF THE INVENTION

This invention relates to an exercise device having handles that are used to turn a disk and a clamp to provide a resistive force to this turning action.

Many types of exercise devices are known. For example, some such devices can be clamped to horizontally disposed surfaces. In another earlier exercise device a disk is turned by a handle and has a friction device to increase the amount of force necessary to turn the handle.

Another prior art device comprises a cylinder which is turned by a handle.

Still another exercise device has a disk which is turned by a handle.

DESCRIPTION OF THE PRIOR ART

Exercise device that have handles and are mounted on horizontally disposed surfaces are known. For example, U.S. Pat. No. 2,817,524 to Sadler discloses a exercise device that can be clamped to horizontally disposed surfaces.

U.S. Pat. No. 4,749,182 to Duggan discloses an exercise device with a disk that is turned by a handle and a friction device to increase the amount of force necessary to turn the handle.

U.S. Pat. No. 5,158,519 to Hughes discloses an exercise device with a cylinder which is turned by a handle.

U.S. Pat. No. 5,580,338 to Scelta et al. discloses an exercise device that has a disk which is turned by a handle.

In the present invention an exercise device is clamped to a horizontally disposed support surface and has a handle which turns a disk with the force required to turn the disk controlled by a clamp all as will be detailed in the specification that follows hereafter.

SUMMARY OF THE INVENTION

This invention relates to an exercise device that is clamp able to a horizontally disposed surface and has a handle that turns a disk whose resistive force against turning can be controlled by clamping action.

It is the primary object of the present invention to provide for an improved exercise device that can be clamped to a horizontally disposed support surface.

Another object is to provide for such a device in which a user operated handle turn a disk and an adjustable resistive force whose resistance can be changed by members that contact the disk.

These and other objects and advantages of the present invention will become apparent to readers from a consideration of the ensuing description and the accompanying drawings.

DESCRIPTION OF THE PREFERRED EMBODIMENT

Figure 1:
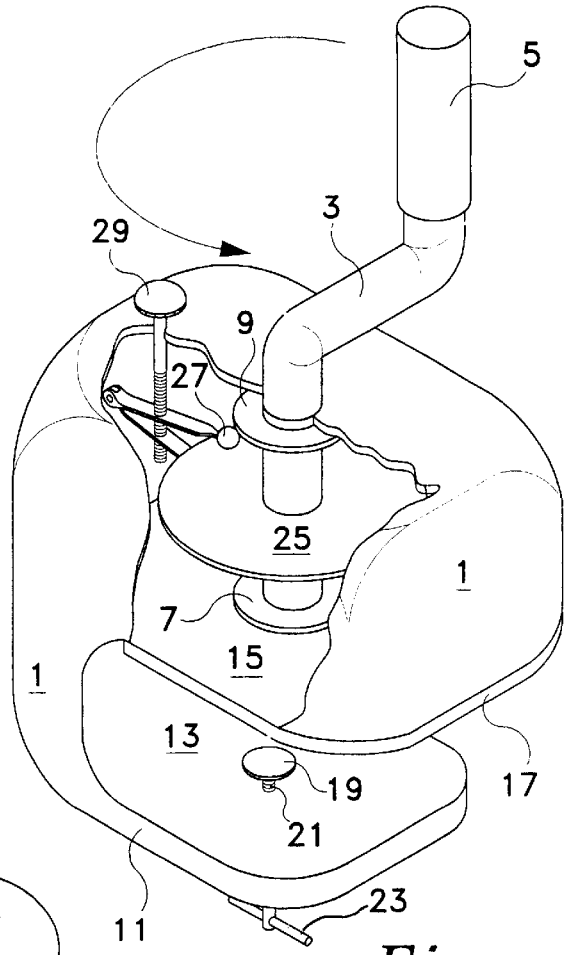
FIG. 1 is a perspective view of the present invention with the housing wall cut away to show the interior working mechanisms.

FIG. 1 is a perspective view of the present invention with a front section of the wall for hollow housing 1 cut away to show the interior working mechanisms. The housing extends completely around a section of the vertically offset shaft 3. At the upper end of shaft 3 is the user operated handle 5. Within the confines of the housing wall 1 are two spaced shaft mounted roller bearings 7 and 9. These bearings engage the interior top and bottom surface walls of the housing and provide for a reduced frictional contact of the shaft portion when rotated.

The housing has a lower depending extension portion 11 joined to the lower portion of the housing to form a U-shaped configuration. An opened space 13 is formed between the lower flat bottom of main housing portion 15 the depending housing extension portion 11. Fixed to the portion 15 is a flat soft pad 17 used to engage the top surface of a horizontally disposed support surface.

Below the pad 17 is a facing swivel pad 19 mounted to the top of a vertically disposed externally threaded shaft 21. Internal threads in a hole formed in portion 11 engage the external threads on shaft 21 to permit the shaft to be adjusted vertically by rotating the lower shaft attached clamp handle 23. This allows the housing mounted support clamp to engage supporting surfaces of different thicknesses within the spacing distance 13.

Within the confines of the upper hollow housing is a flat disk 25. A center hole in this disk allow the shaft 3 to be fixedly mounted to the disk. As a user turns the shaft by handle 5, the disk 25 moves or rotates in unison with the shaft. Disk 25 is a round flat member centered on the shaft 3 and extending completely around it and outwardly from the shaft. Engaging the upper and lower surfaces of the disk 25 are two separate roller wheels 27. These roller wheels, as best described with respect to FIG. 2, allow the amount of resistive force on the contacted disk's surfaces to be varied by turning a control knob 29 external of the housing.

Figure 2:
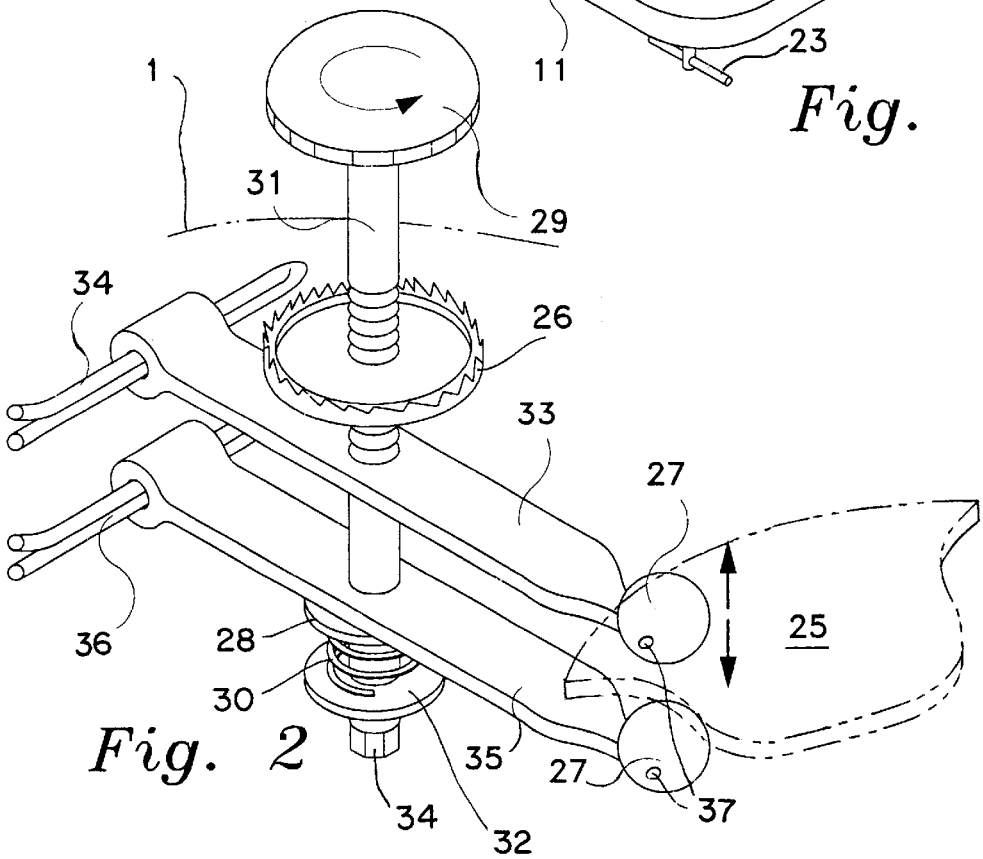
FIG. 2 is an enlarged detailed view of the disk adjusting clamp shown generally in FIG. 1.

FIG. 2 is an enlarged detailed view of the disk adjusting clamp shown generally in FIG. 1. The resistive force adjusting clamp is mainly confined to the interior of the hollow housing except for a small upper portion of the shaft 31 which mounts the external control knob 29. A section of the shaft 31 has exterior threads that engage interior threads in each of the a pair of spaced flexible arms 33 and 35. Each of the spaced arms has a rear mounted connecting shaft 34 and 36, respectively. These two connecting shafts are mounted in slots in the interior walls of housing 1 and join the ends of the two arms together. At the opposite ends of each arm is a roller 27 journaled to freely rotate at a mounting pin 37. As the control knob 29 rotates shaft 31 each of the arms move on their engaged threaded surfaces to change the amount of force needed to rotate the roller 27. This changeable resistance occurs because the individual separate arms in the pair of arms 33 and 35 are spaced apart in a V-shaped relationship with the smaller part or apex part of the V- being near rear connecting shaft 34 and 36. As the roller 27 becomes more impeded from freely rolling, this means the contacted resistance against the surface of disk 25 increases and more force is needed to turn connected handle 5. Above the pair of spaced arms 33 and 35 is a center holed locking nut 26 that engages the underside of the housing surface. Below the same pair of arms is a top washer 28 with a still lower spring 30 with a retaining end member 32. A center hole in retaining end member 32 receives a screw 34 inserted through housing bottom 15 to maintain the shaft 31 upright as locking nut bears against the housing 1 interior surface. The spring 30 and its top washer force the pair of arms upwardly so that their respective end rollers 27 can engage the top and bottom surfaces of disk 25.

Figure 3:
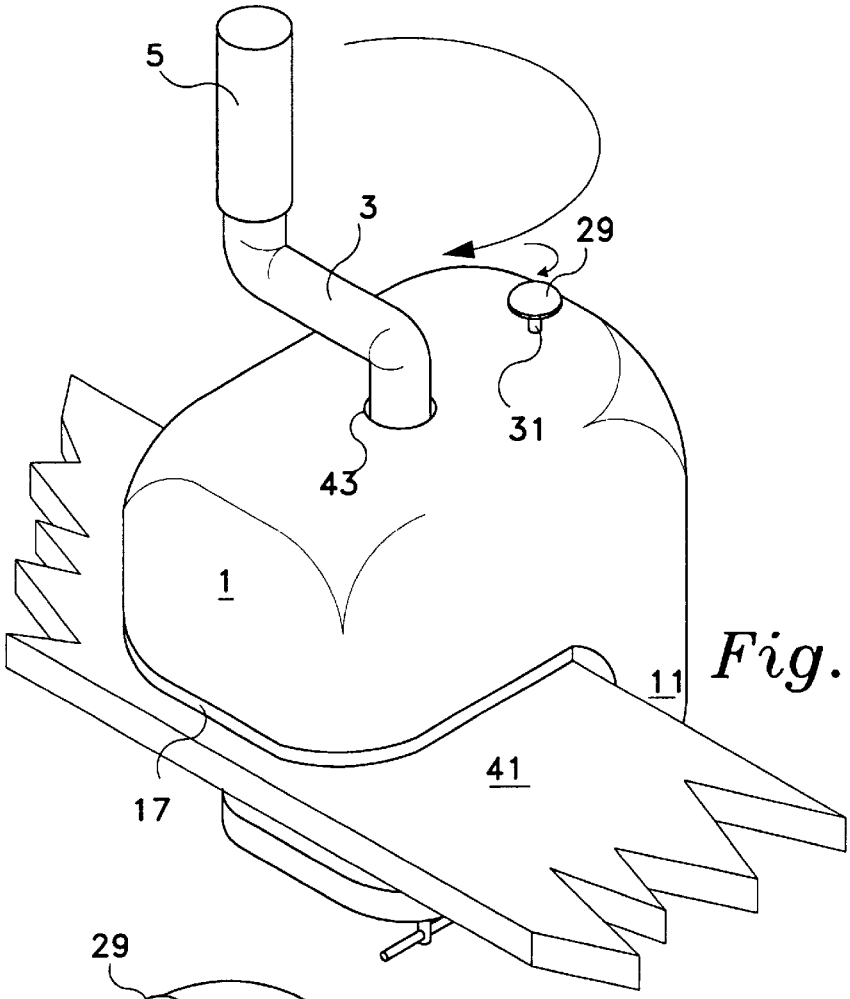
FIG. 3 is a perspective view showing the typical placement of the FIGS. 1–2 system on a horizontally disposed support surface.

FIG. 3 is a perspective view showing the typical placement of the FIGS. 1–2 system on a horizontally disposed support surface 41. Surface 41 can vary depending on what is convenient and strong enough to support the exercise device. It could be the side of a table, a bench, a bookshelf, etc. The housing wall is turned from that shown in FIG. 1 and has a generally domed shaped upper portion with a hole 43 for the shaft 3. The resistance control knob 29 with a small upper portion of shaft 3 extends through a smaller housing hole in the same upper housing portion. Part of the support surface pad 17 on the bottom of the housing is also shown along with part of the housing extension 11. The lower support surface clamp with its upper swivel pad 19, shaft 21 and handle 23 are not visible in this view as they are below the surface 41.

Initially, the support surface clamp is adjusted in a vise like action to fix the housing 1 to the surface 41. Then the amount of resistive force on the internal housing disk 25 can be varied as desired by turning the control knob 29.

Figure 4:
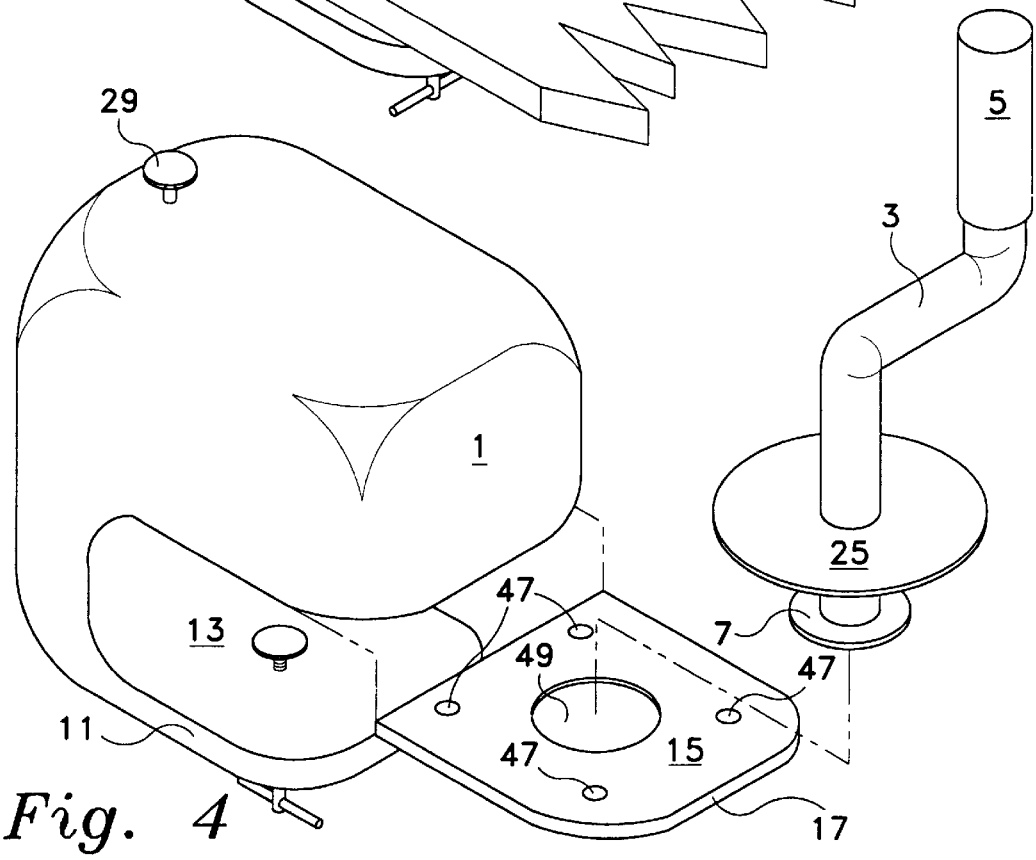
FIG. 4 is an exploded perspective view of most of the major components of the device.

FIG. 4 is an exploded perspective view of most of the major components of the device. In addition to those components previously described, there is a bottom plate 15 that fits under the surface of the upper hollow housing portion and is fixed to it by screws or other fasteners extending through holes 47. Internal fastener receiving members formed in the interior of the housing receive the screws. In approximately the center of the plate 15 is a recess portion 49 sized and configured to receive the lower bearing 7 of the shaft 3. This insures the lower end of the shaft will not moves out of the recess as it is rotated. Below and attached to the plate 15 is the soft support surface engaging pad 17. Pad 17 has the same general outline as the plate 15.

The hollow housing may be made of a strong plastic material, like ABS Acrylonitrile-butadiene-styrene) plastic. Preferably the shafts 3 and 31 are made of metal as well as the pairs of arms 33 and 35. The disk 25 is rigidly attached to the shaft 3 with a connection (e.g., welding) strong enough to withstand the forces acting on it as the user turns the handle 5 and its rotation is resisted by the engaged rollers 27.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An exercise device comprising:

a housing having an interior space and a first clamp for attaching the housing to a horizontally disposed surface;

a first shaft rotatably mounted to said housing and having an interior length located within said interior space of said housing;

a handle mounted to said first shaft and located outside of said housing to rotate said first shaft relative to said housing;

a disk fixed to said interior length of said first shaft for rotation with said first shaft, said disk having opposite surfaces;

a control knob mounted to a second shaft rotatably mounted to said housing;

said second shaft having a threaded portion extending within said interior space of said housing;

a pair of movable arms located within said interior space of said housing, each arm having a first end mounted to said interior space of said housing for movement relative to said housing;

each arm having a second end with a roller and located on a respective side of opposite surfaces of said disk; and said pair of movable arms operatively connected to said threaded portion of said second shaft so that each opposite roller engages the respective side of said disk to clamp said disk with increasing or decreasing force, in resisting rotation of said disk, wherein the user mounts said housing on a horizontally disposed support surface, adjusts said control knob to move said arms and rollers to select a desired resistance to rotation of said disk, and exercises by engaging said handle and moving said handle against the resistance provided by the engagement between said rollers and said disk surfaces.

2. The exercise device of claim 1, wherein said first clamp consists of a threaded shaft mounted to an extension of the housing with an upper plate on the threaded shaft.

3. The exercise device of claim 2, wherein said upper plate is a swivel plate.

4. The exercise device of claim 3, wherein said first shaft includes bearing members located along its length with one of the bearing members mounted on a lower end of said first shaft.

5. The exercise device of claim 1, wherein said first shaft is mounted to bearing members on said housing with one of said bearing members mounted on a lower end of said first shaft.

6. The exercise device of claim 1, wherein each of said movable arms is pivotally mounted to said interior of said housing for pivotal movement relative to said housing.

7. The exercise device of claim 1, wherein said housing includes a pad for engaging a top surface of the horizontally disposed support surface.

* * * * *